US005127578A

United States Patent [19]

Choi et al.

[11] Patent Number: 5,127,578

[45] Date of Patent: Jul. 7, 1992

[54] DUST CLEANING APPARATUS FOR CLEANING CATHODE RAY TUBES

[75] Inventors: Dae-ok Choi; Hee-jun Kim, both of Kyunggi, Rep. of Korea

[73] Assignee: Samsung Electron Devices Co., Ltd., Kyunggi-Do, Rep. of Korea

[21] Appl. No.: 724,933

[22] Filed: Jul. 2, 1991

[30] Foreign Application Priority Data

Jul. 3, 1990 [KR] Rep. of Korea ..... 90-10035

[51] Int. Cl.[5] ..... 134 167 R; 134 168 R; 134 179; B05B 3/16

[52] U.S. Cl. ..... 239/229; 239/389; 239/507; 239/516

[58] Field of Search ..... 239/222.17, 229, 382, 239/389, 504, 505, 507, 509, 510, 516; 134/167 R, 168 R, 179

[56] References Cited

U.S. PATENT DOCUMENTS

| | | | |
|---|---|---|---|
| 564,906 | 7/1896 | Van Camp | 239/389 |
| 1,993,011 | 3/1935 | Lindberg | 239/505 |
| 2,914,258 | 11/1959 | Ruetsch | 239/569 |
| 2,963,228 | 12/1960 | Hait | 239/229 |
| 3,009,648 | 11/1961 | Hait | 239/222.17 |
| 3,664,585 | 5/1972 | Curtis | 239/516 |
| 4,526,321 | 7/1985 | Knudsen | 239/229 |

FOREIGN PATENT DOCUMENTS

| | | | |
|---|---|---|---|
| 543821 | 7/1957 | Canada | 239/382 |

*Primary Examiner*—Andres Kashnikow
*Assistant Examiner*—Karen B. Merritt
*Attorney, Agent, or Firm*—Cushman, Darby & Cushman

[57] ABSTRACT

A dust cleaning nozzle for cleaning a cathode ray tube comprises a pipe with an axially extending hollow part, and an ejecting angle changing mechanism attached to one end of the pipe. The nozzle, after insertion through the neck of the cathode ray tube, changes the ejecting angle of air ejected from the ejecting angle chainging mechanism with respect to the axis of the pipe so as to be efficient in removing dust from the tube.

7 Claims, 2 Drawing Sheets

DUST CLEANING APPARATUS FOR CLEANING CATHODE RAY TUBES

FIELD OF THE INVENTION

The present invention relates to a dust cleaning apparatus for cathode ray tubes, and more particularly to a dust cleaning apparatus for cleaning the inside of cathode ray tubes.

BACKGROUND OF THE INVENTION

Generally, cathode ray tubes are sealed in a high vacuum in order to facilitate the movement of free electrons and in order to improve withstand voltage characteristics of the tubes. If foreign matter such as dust remains inside the tubes, the discharge rate increases and sharp pictures cannot be obtained due to scattering of electron beams. Accordingly, any dust in cathode ray tubes should be completely removed before the electron gun is inserted and before the tubes are sealed.

A conventional nozzle for cleaning dust from cathode ray tubes is shown in FIG. 1. This conventional nozzle is made in such a manner that one or more holes 2*b* communicating with hollow part 2*a* are formed near the end of thin and long pipe 2. This hollow part 2*a* extends axially in the direction of the pipe's length.

To remove dust in cathode ray tube 30 with the conventional dust cleaning nozzle 1, the nozzle 1 is inserted inside cathode ray tube 30 through neck 30*a*. After that, dust-free compressed-air is ejected into cathode ray tube 30 via hollow part 2*a* and through hole 2*b* of the nozzle 1. Nozzle 1 is simultaneously revolved to blow foreign matter stuck to the inner face of the cathode ray tube, the shadow mask, the frame and/or the inner shield out neck 30*a* and from the tube.

With the conventional nozzle 1, however, all of a high pressure is ejected only in a certain direction through holes 2*b* formed near the end of nozzle 1 so that only part of the inside area of the cathode ray tube is exposed to the high pressure air. Accordingly, dust cleaning is not directly performed on the entire inside area of the cathode ray tube.

SUMMARY OF THE INVENTION

Therefore, it is an object of the present invention to provide an apparatus for cleaning dust from cathode ray tubes which ejects air of a high pressure into the inner cavity of the cathode ray tubes in multiple directions so as to improve the dust cleaning rate.

To attain this object, the present invention, comprises: a pipe having a hollow part; and an ejecting-angle changing means, attached to one end of the pipe, for changing the ejecting direction of air ejected from the hollow part.

BRIEF DESCRIPTION OF THE DRAWINGS

The above object and other advantages of the present invention will become more apparent by describing in detail a preferred embodiment of the present invention with reference to the attached drawings in which.

DETAILED DESCRIPTION OF THE INVENTION

Figure 1:
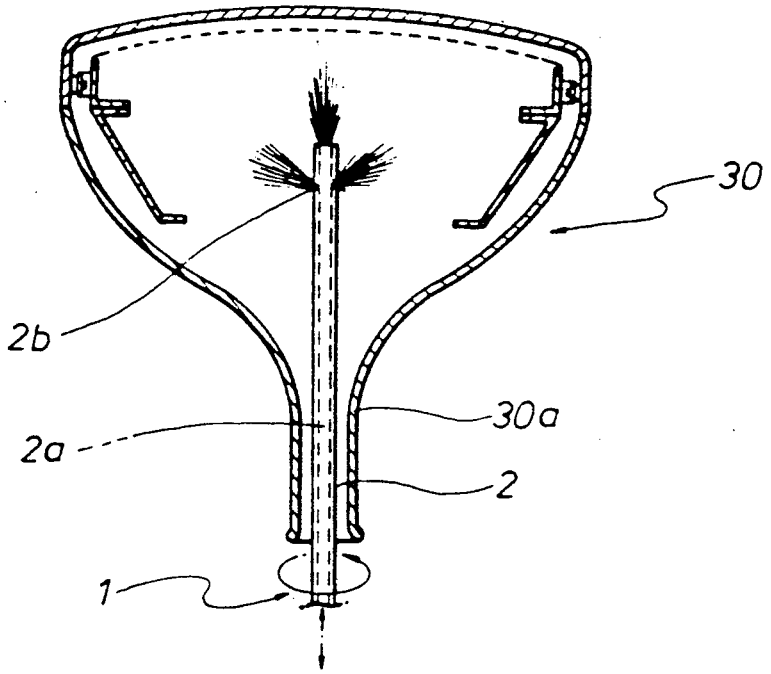
FIG. 1(PRIOR ART)
FIG. 1 illustrates the use of a conventional nozzle for cleaning dust from a cathode ray tube.
Figure 2:
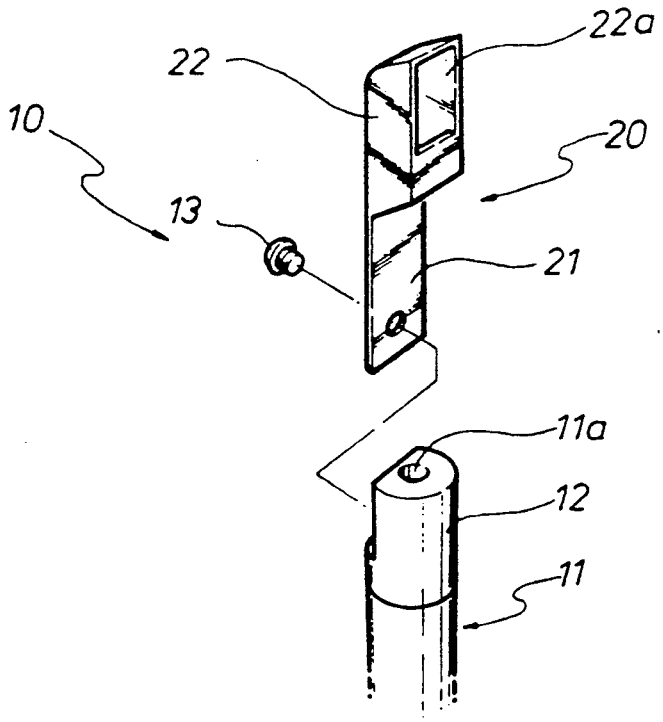
FIG. 2 is an exploded perspective view of a nozzle for cleaning dust from a cathode ray tube according to the present invention.
Figure 3:
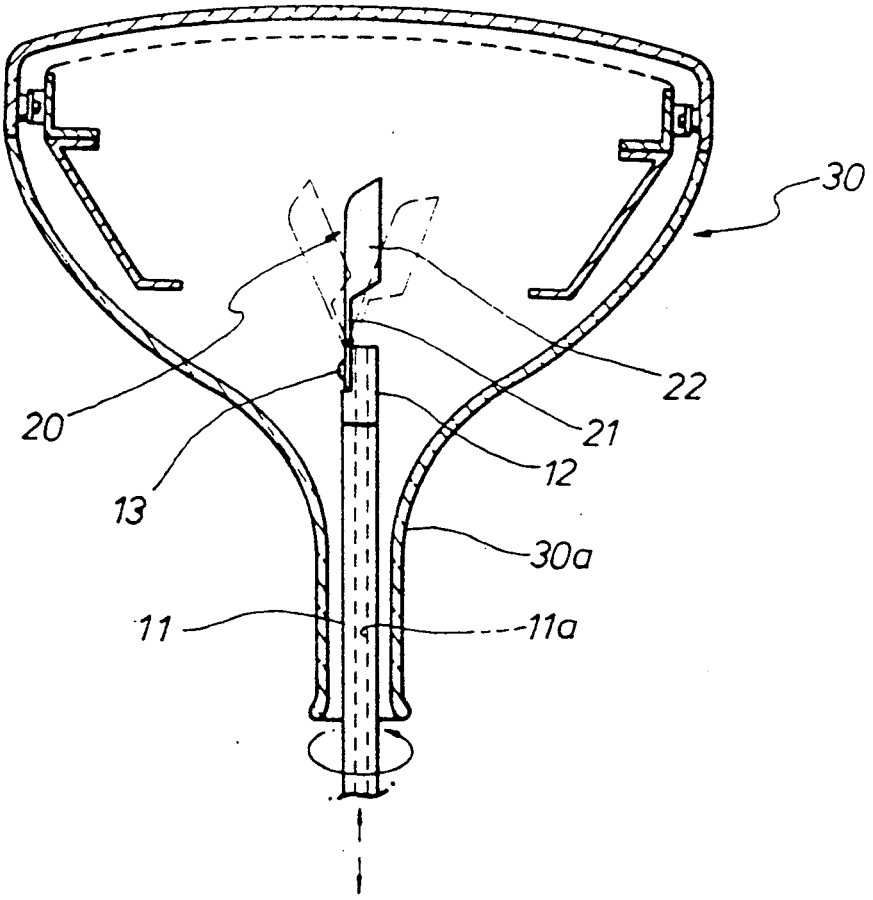
FIG. 3 illustrates the use of the nozzle for cleaning dust from a cathode ray tube shown in FIG. 2.

FIG. 2 shows a preferred embodiment of a nozzle for cleaning dust in a cathode ray tube according to the present invention. The apparatus 10 for cleaning dust in a cathode ray tube comprises a thin long pipe 11 having a hollow part 11*a* and an ejecting angle changing means 20 for changing the ejecting direction of air ejected from the hollow part 11*a*. The ejecting-angle changing means 20 is attached to an end of the pipe 11.

The ejecting angle changing means 20 comprises a shaking plate 21 attached to the end of the pipe 11, and a guide portion 22 attached to the shaking plate 21 for guiding the air ejected from the hollow part 11*a* of the pipe 11 in the right angled direction of the shaking plate 21.

The guide portion 22 has an aperture 22*a* in the right angled direction of the shaking plate 21 and a shape of square pipe with the face opposed to the hollow part 11*a* open. The guide portion 22 may be made by folding a square pipe or cylinder with a certain length by a right angle. The air inflow opening of the guide portion 22 should be located directly above the hollow part 11*a* formed in the pipe 11. The shaking plate 21 should be made of material with elasticity. Furthermore, it is desirable that a nozzle member 12 be provided which is attached to the end of the pipe 11. If such a nozzle member 12 is provided, the shaking plate 21 should be fixed with a set screw 13 on the peripheral face of the nozzle member 12. The nozzle for cleaning dust from a cathode ray tube 10 is, while inserted into the tube, variously revolved and lifted by a lifting means and a revolving means not shown in the drawings.

Operation of the nozzle for cleaning dust from cathode ray tubes according to the present invention will be described below.

First, the apparatus for cleaning dust 10 is inserted into a cathode ray tube 30 through its neck 30*a* and dust-free air is supplied with a high pressure through the hollow part 11*a* of the pipe 11. This high pressure air is then ejected in the right angled direction of the shaking plate 21 through the guide portion 22 of the ejecting angle Changing means 20 attached to the end of the hollow part 11*a*. As the high pressure air is ejected by the guide portion 22 in the right angled direction of the shaking plate 21, a force is exerted in the opposite direction of the ejecting direction of the air thereby making the shaking plate 21 bend in a certain direction so that the guide portion 22 of the shaking plate 21 deviates from the vertically upper part of the hollow part 11*a* the from which air of a high pressure is ejected. If the guide portion 22 deviates from the vertically upper part of the hollow part 11*a*, the inflow quantity of the air of a high pressure ejected from the hollow part 11*a* into the guide portion 22 is reduced and the force exerted on the shaking plate 21 is reduced. The guide portion 22 therefore recovers so that it is directly above part of the hollow part due to the restoring force of the shaking plate 21. Accordingly, the inflow quantity of air into the guide portion 22 increases, and the force exerted on shaking plate 21 becomes stronger. The sequence described above is repeated so that the ejecting angle changing means 20 is shaken back and forth at a high speed. The degree of shaking of the ejecting angle changing means 20 depends on the quantity and the ejecting speed of the air applied to the guide portion 22 from the hollow part 11*a*.

In addition to the ejecting angle changing means being shaken at a high speed, and in addition to the varying of the ejecting angle from the guide portion 22, the nozzle is also revolved a number of times by a revolving means and is also lifted by a lifting means. The revolving means and lifting means are not shown in the drawings. As a result, foreign matter in cathode ray tubes is cleanly removed. Especially, the apparatus for cleaning dust can eject high pressure air to the corners of the panel of cathode ray tubes so that the apparatus is very efficient in removing dust from these corners.

As described above, the apparatus for cleaning dust from cathode ray tubes according to the present invention removes dust from cathode ray tubes by varying the ejecting angle of air inside the tubes. Accordingly, the number of tubes rendered inferior by foreign matter can be reduced with this invention.

What is claimed is:

1. A dust cleaning apparatus for cleaning an inside surface of a cathode ray tube, comprising:

a pipe having a longitudinal axis, an end nozzle portion with a nozzle, and a hollow conduit means extending along the longitudinal axis of the pipe for conducting high pressure air through the pipe and to the end nozzle portion; and ejecting angle changing means, which extends from the end nozzle portion, for using a pressure exerted by said high pressure air when said high pressure air is ejected from said ejecting angle changing means to change an angle at which said high pressure air is ejected with respect to said axis of said pipe.

2. The dust cleaning apparatus of claim 1, wherein said ejecting angle changing means comprises a flexible shaking plate portion and a outlet guide portion, one portion of said flexible shaking plate being fixed to said end nozzle portion of the pipe and another portion of said shaking plate supporting said outlet guide portion, said outlet guide portion forming an inlet aperture, an inlet opening extending from said inlet aperture in an inlet axial direction, an outlet aperture, and an outlet opening extending in an outlet axial direction, said outlet axial direction being angled with respect to said inlet axial direction.

3. The dust cleaning apparatus of claim 2, wherein said shaking plate of said ejecting angle changing means is attached to a planar peripheral face of the end nozzle portion.

4. The dust cleaning apparatus of claim 2, wherein said high pressure air ejected from said ejecting angle changing means causes said outlet guide portion to move in an oscillating fashion with respect to the end nozzle portion of the pipe.

5. The dust cleaning apparatus of claim 2, wherein said outlet aperture has a rectangular shape.

6. The dust cleaning apparatus of one of claims 2 to 5, wherein said outlet axial direction is substantially perpendicular to said inlet axial direction.

7. The dust cleaning apparatus of claim 2, wherein said flexible shaking plate flexes due to said pressure exerted by said high pressure air when said high pressure air is ejected from said ejecting angle changing means, said flexing of the shaking plate causing said inlet opening to move with respect to said nozzle.

* * * * *